US012722071B2

(12) United States Patent
McCoy et al.

(10) Patent No.: US 12,722,071 B2
(45) Date of Patent: Sep. 1, 2026

(54) AUTOMATIC CARD DEALING SYSTEM FOR USE WITH GAMING TABLE

(71) Applicants: Jeremiah B.B. McCoy, Portland, OR (US); Cassidy Thomas, Bellingham, WA (US)

(72) Inventors: Jeremiah B.B. McCoy, Portland, OR (US); Cassidy Thomas, Bellingham, WA (US)

( * ) Notice: Subject to any disclaimer, the term of this patent is extended or adjusted under 35 U.S.C. 154(b) by 409 days.

(21) Appl. No.: 18/419,858

(22) Filed: Jan. 23, 2024

(65) Prior Publication Data

US 2024/0307758 A1 Sep. 19, 2024

Related U.S. Application Data

(60) Provisional application No. 63/462,896, filed on Apr. 28, 2023.

(51) Int. Cl.

| | |
|---|---|
| ***A63F 1/06*** | (2006.01) |
| ***A63F 1/10*** | (2006.01) |
| ***A63F 1/14*** | (2006.01) |

(52) U.S. Cl.

CPC ..... *A63F 1/067* (2013.01); *A63F 1/10* (2013.01); *A63F 1/14* (2013.01)

(58) Field of Classification Search

CPC ..... A63F 1/067; A63F 1/10; A63F 1/14
See application file for complete search history.

(56) References Cited

U.S. PATENT DOCUMENTS

2019/0021489 A1* 1/2019 Morag ..... A47B 25/00

OTHER PUBLICATIONS

International Search Report and Written Opinion for PCT/US2024/026449 dated Aug. 14, 2024 (14 pages).

* cited by examiner

*Primary Examiner* — Brian O Peters
(74) *Attorney, Agent, or Firm* — FisherBroyles, LLP; Rob L. Phillips

(57) ABSTRACT

A system and method for distributing playing cards to multiple player positions at a gaming table. The system includes a card input apparatus, one or more card transportation apparatuses and a card delivery apparatus at each player position. The card input apparatus, one or more card transportation apparatuses and card delivery apparatuses are installed beneath the gaming table. The card transportation apparatuses may comprise different designs for moving cards from the card input apparatus to the plurality of card delivery apparatuses including, for example, (i) a track and card distribution carriage; (ii) a conveyor and plurality of gates configured to guide cards; and (iii) a series of chutes using directed air. Regardless of the specific design, cards are automatically dealt to players at selective player positions beneath the gaming table.

13 Claims, 18 Drawing Sheets

AUTOMATIC CARD DEALING SYSTEM FOR USE WITH GAMING TABLE

CROSS-REFERENCE

This application claims priority to U.S. Patent Application No. 63/462,896 filed on Apr. 28, 2023, which is incorporated herein by reference.

FIELD OF THE INVENTION

The embodiments of the present invention relate to the field of card handling and dealing systems, particularly to an automatic playing card distribution system for gaming tables, including poker tables.

BACKGROUND

Card shuffling machines are known in the prior art. Such shuffling machines commonly use mechanical and/or digital devices to arrange playing cards into a random order, and dispense the cards in stacks or individual hands, to a human dealer for dealing to players. The process of dealing the shuffled cards to the players takes time decreasing the number of hands playable per hour.

It would be advantageous to develop an automated card dealing system to expedite the dealing of cards to players and therefore increase the number of hands playable in a given time period.

SUMMARY

At present there is no known device that delivers or deals individual hands of cards directly to locations at a gaming table proximate to where the players are seated. In one embodiment of the present invention, a card dealing system delivers cards to holding locations proximate to each player at a gaming table to start the hand of the game being played and once the hand ends, the card dealing system deals the next hand. The benefit of the card dealing system described herein is the time-savings between the hands of play since the cards can be distributed simultaneously and directly to the players rather than waiting for the dealer to move the cards individually to each player resulting in an estimated time savings of approximately fifteen seconds per hand. For casinos dealing thousands of hands daily, the fifteen seconds per hand represents substantial additional revenue for casinos as more hands can be dealt and played.

The system for dealing cards may comprise a surface for supporting a stack of pre-shuffled playing cards. In one embodiment, the stack of pre-shuffled cards is lowered below the gaming table by mechanical means. Also, disclosed is a feed roller with a frictional outer surface and apparatus for driving the feed roller, a pair of pick-up rollers to advance individual cards from the feed roller and into a carriage mechanism for holding a card stack. In one embodiment, an apparatus for distributing the cards to the player locations comprises a card distribution carriage on wheels supported by rails mounted below the gaming table surface, an apparatus for driving the wheels, a stack of receiving compartments moveable vertically by threaded rods and means of rotating the threaded rods, a roller with a frictional surface to move the cards out of the card distribution carriage and a method of rotating the roller. From the card distribution carriage, the cards are delivered to card delivery apparatuses proximate to each occupied player position. The card delivery apparatuses then deliver or deal the cards to the players via one or more rollers which move the cards to the upper surface of the gaming table.

Another embodiment uses a conveyor and gates configured to direct cards to the card delivery apparatuses. Another embodiment uses a series of chutes through which directed air moves cards to the card delivery apparatuses.

Other variations, embodiments and features of the present invention will become evident from the following detailed description, drawings and claims.

DETAILED DESCRIPTION OF THE INVENTION

Figure 1:
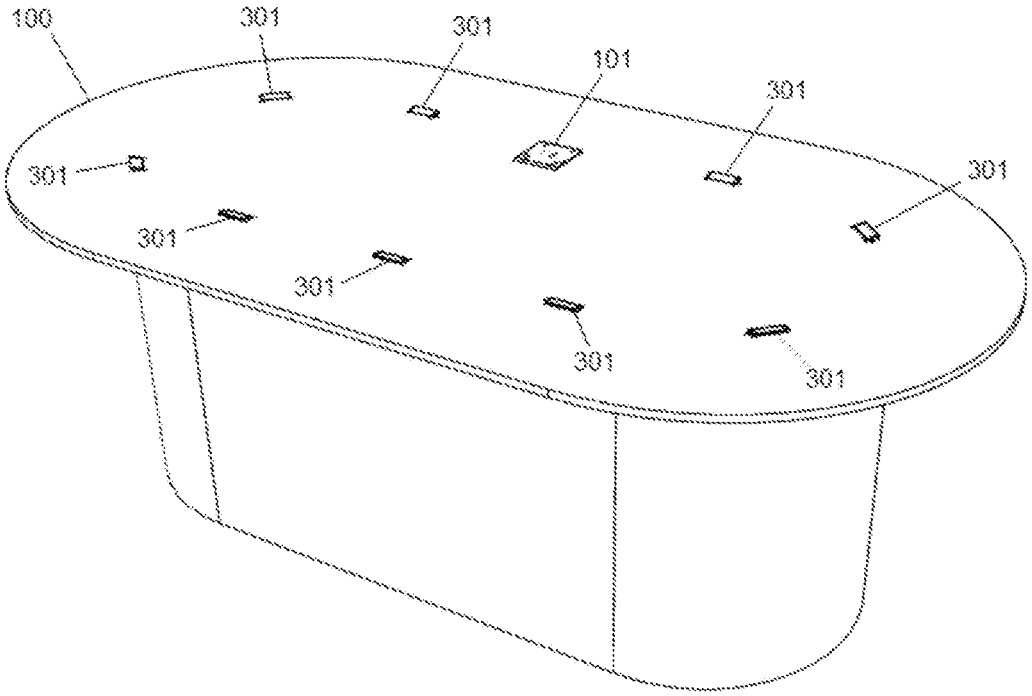
FIG. 1 is a perspective drawing of one embodiment of a gaming table showing the surface of the gaming table, the location of a card input portion of the card dealing system for the dealer and the individual card distribution locations at player positions.

It will be understood that the scope of the appended claims should not be limited by particular embodiments set forth herein, but should be construed in a manner consistent with the specification as a whole.

Those skilled in the art will recognize that the embodiments of the present invention may involve both hardware and software elements which portions are described below in such detail required to construct and operate the system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams.

The embodiments of the present invention detailed below comprise a card delivery system which may include a controller (not shown) or processor (not shown) programmed to control the various components of the system.

Described below is a gaming table system including broadly a card input apparatus, one or more card transportation apparatuses and card delivery apparatuses for automatically dealing cards to player positions at a gaming table. The card input apparatus, one or more card transportation apparatuses and card delivery apparatuses are connected to the underside of the gaming table.

As shown in FIG. 1, the automatic card dealing system involves a gaming table (100) with a designated access location for a card input apparatus (101) which is operated by the dealer of the game and a plurality of card delivery outlets (301). In one embodiment, the plurality of card delivery apparatuses (300) are spaced approximately evenly around the upper surface of the table for players to receive their cards. In one play example, the dealer loads a pre-shuffled stack of cards into the card input apparatus (101) after which the stack of cards is moved to a holding location within the card delivery apparatus (300) until the cards are ready to be dispensed to the players at the beginning of the next hand. In one example, this operation is carried out beneath the gaming table while a current hand is in play.

Figure 2:
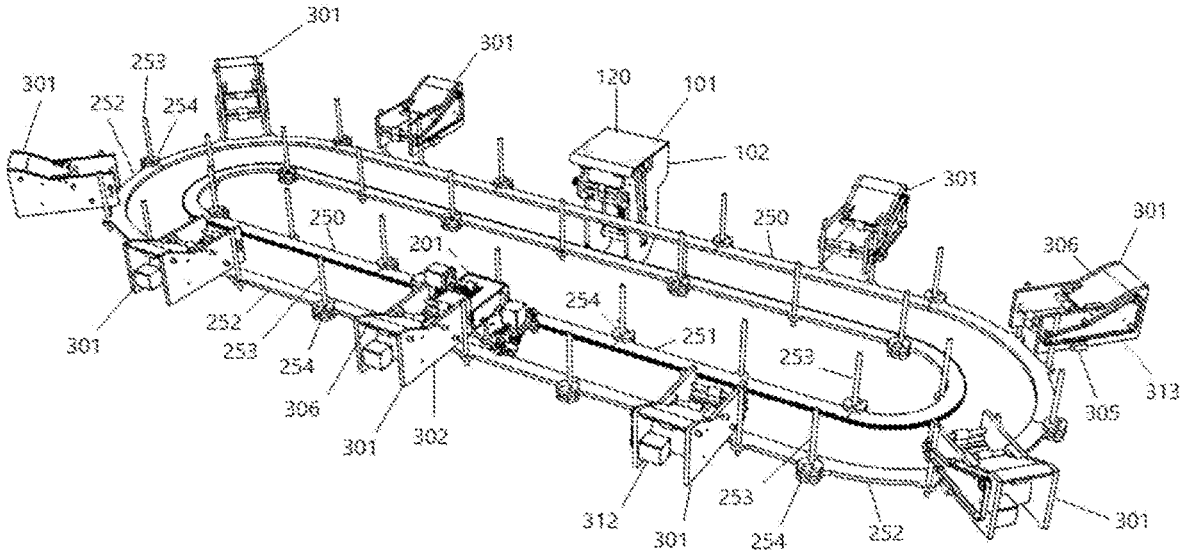
FIG. 2 is a perspective view showing one embodiment of a card dealing system mounted beneath the upper surface of the gaming table shown in FIG. 1, including the card input apparatus, track and card distribution carriage and card delivery apparatuses for delivering cards to the players.
Figure 5:
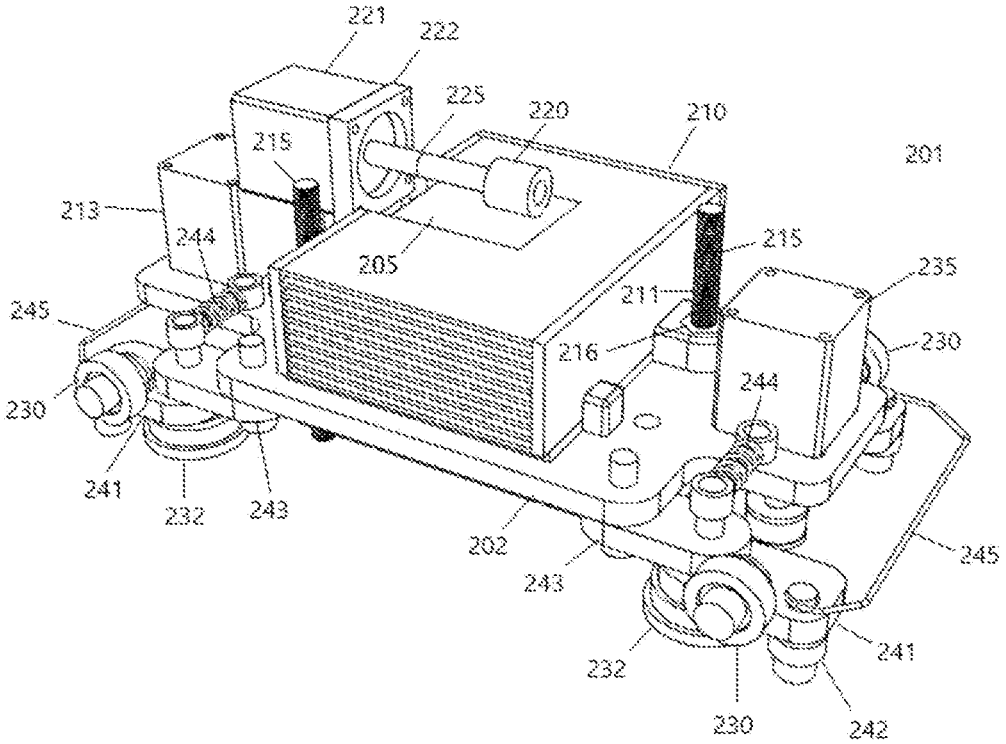
FIG. 5 is a perspective view of one embodiment of the card distribution carriage.
Figure 6:
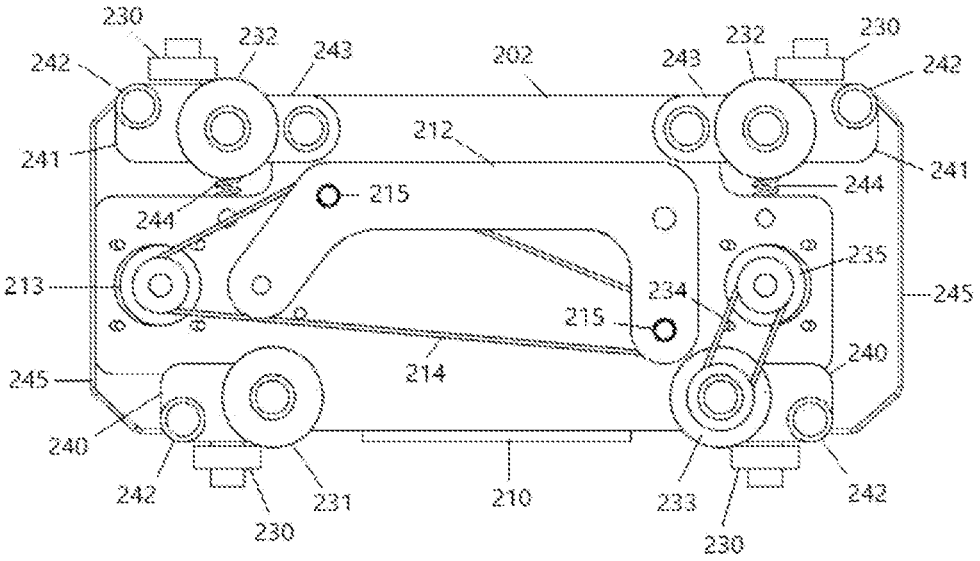
FIG. 6 is a bottom view of one embodiment of the card distribution carriage.
Figure 7:
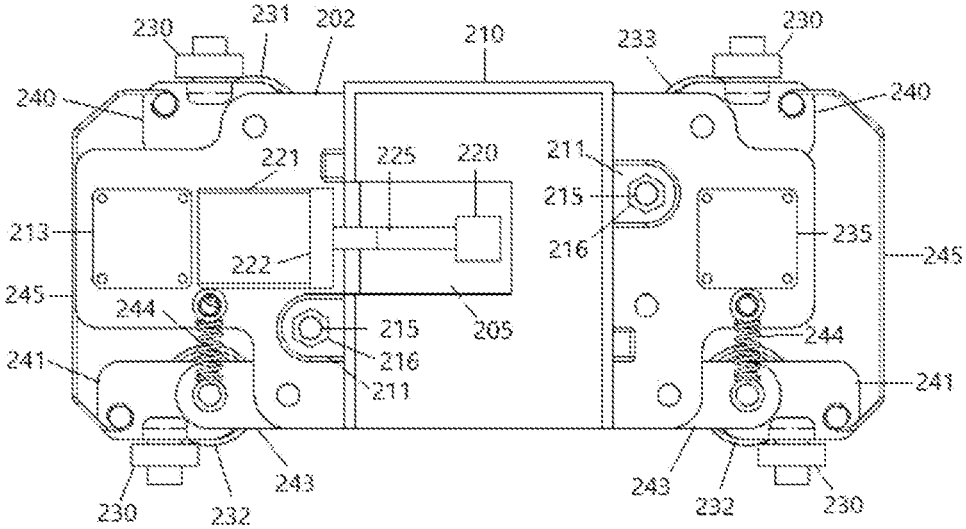
FIG. 7 is a top view of one embodiment of the card distribution carriage.

As shown in FIG. 2, a mechanism to distribute cards from the card input apparatus (101) to the card delivery apparatuses (300) is mounted beneath the gaming table and comprises three sub-systems including the card input apparatus (101), a card distribution carriage (201) and a plurality of card delivery apparatuses (300). In one embodiment, the card input apparatus (101) receives one or more decks of pre-shuffled cards via an open dealing apparatus lid (120). From inside the card input apparatus (101), the cards are individually transferred to the card distribution carriage (201). In one embodiment, the card distribution carriage (201) is moveable along, and supported by, a track (250). In one embodiment, the track (250) comprises inner track sections (251) and outer track sections (252). The card distribution carriage (201) moves from the location of the card input apparatus (101) around the track (250) stopping adjacent or proximate to each of the card delivery apparatuses (300) so that the cards making up the individual hands for each player can be transferred and held awaiting delivery to the surface of the table via the card delivery apparatuses (300). In one embodiment, the vertical position of the card distribution carriage (201) is controlled using a stepper drive motor (235) (shown in FIG. 5).

In one embodiment, the track (250) is suspended from the underside of the gaming table surface by track suspension brackets (253) with the individual track sections joined by track section connectors (254) which connect the individual inner track sections (251) to form the inner section of the track (250) and connect the individual outer track sections (252) to form the outer section of the track (250).

Figure 3:
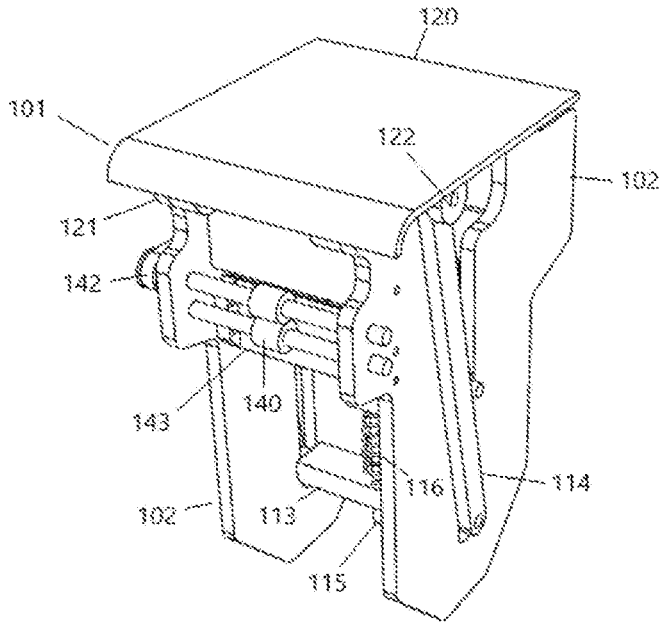
FIG. 3 is a perspective view of one embodiment of one of the sub-components of the card dealing system shown in FIG. 2 showing one embodiment of the card input apparatus of the card dealing system which accepts one or more pre-shuffled decks of cards.
Figure 4:
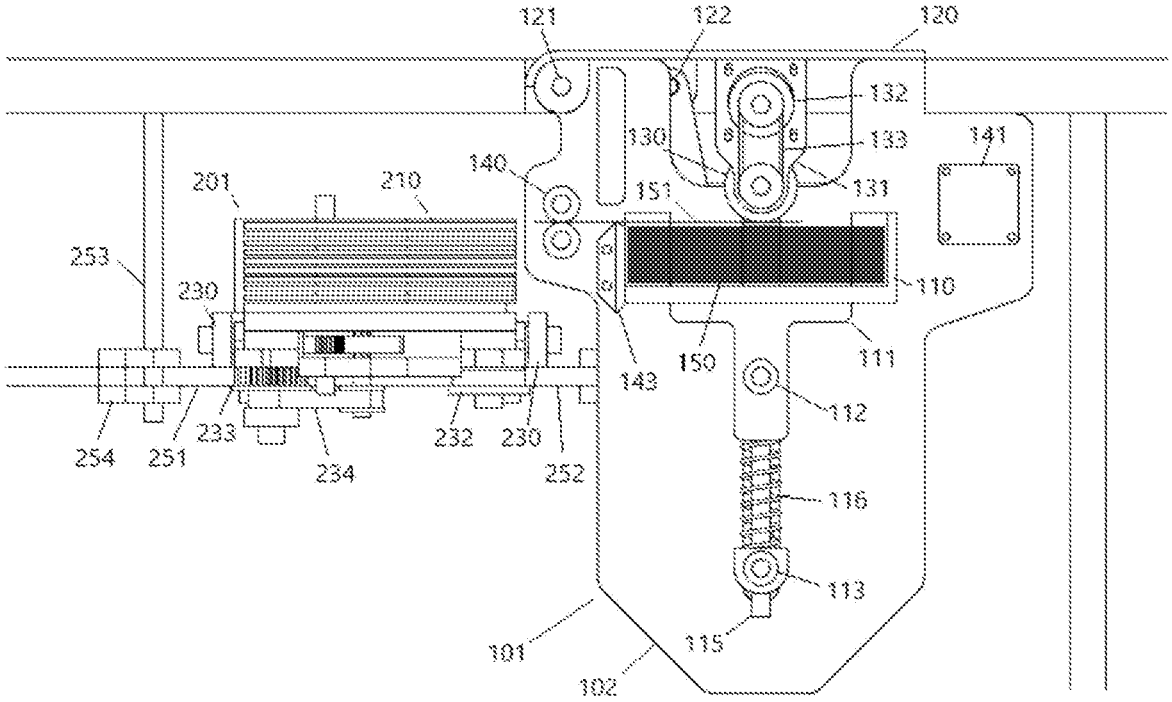
FIG. 4 is a cut-away side view of one embodiment of the card input apparatus, card distribution carriage and supporting track.

As shown in FIGS. 3 and 4, the card input apparatus (101) may comprise a cover lid (120) capable of opening to allow the one or more decks of cards (150) to be placed in a card holder (110) that may move vertically between the card input apparatus side panels (102). The card deck holder (110) may be supported by a card deck holder support (111). In one embodiment, the card deck holder support (111) comprises upper support arms (112), a support post (115), lower support arms (113), and a card deck holder spring (116). The card deck holder (110) may be lowered into the body of the card input apparatus (101) by the deck holder lift arm (114) which is attached by the lift arm pivot (122) to the cover lid (120) and to the card deck holder support lower arms (113). In this embodiment, the upper support arms (112) and lower support arms (113) fit into grooves in the side panels (102) that maintain the vertical orientation of the card deck holder support (111) as the card deck holder (110) is lowered into the card input apparatus (101).

Further referring to FIGS. 3 and 4, when the cover lid (120) is closed, a feed roller (130) comes into contact with the top surface of the one or more decks of cards (150) compressing the card deck holder spring (116) so that the top surface of the one or more decks of cards (150) maintains contact with the feed roller (130) even when cards are removed thus reducing the height of the one or more decks of cards. In other words, card deck holder spring (116) maintains an upward force on card deck holder (110) even as cards are being removed therefrom. The feed roller (130) may be mounted on a bracket (131) affixed to the underside of the cover lid (120) along with the feed roller motor (132) connected by a feed roller drive belt (133) that provides the rotational force to rotate the feed roller (130). In one embodiment, the feed roller (130) includes a frictional surface to facilitate moving cards individually from the top of the card deck (150). A card pickup wall (143) may also have a frictional top surface to act upon the bottom surface of the cards and prevent multiple cards being moved simultaneously out of the card deck holder (110). After a top card (151) from the one or more decks is moved out of the card deck holder (110) over the card pickup wall (143), the top card (151) continues moving until the top card (151) engages pickup rollers (140) which continue to move the card (151) thus guiding the top card (151) into an adjacent slot in the card receiving stack (210) of the card distribution carriage (201). In one embodiment, the pickup rollers (140) may be connected by a pickup roller drive belt (142) to a pickup roller motor (141) which provides the rotational force for the pickup rollers (140) and can be controlled to move the card (151) the remaining distance from the top of the deck into card receiving stack (210).

Referring to FIGS. 4 to 7, in one embodiment, the card distribution carriage (201) comprises a carriage baseplate (202) to which other components are attached, a vertically moveable card receiving stack (210) supported by receiving stack lifters (211), a card distributor feed roller (220) configured to move playing cards to and from the receiving stack (210), support wheels (230) and track wheels (231, 232) to support and guide the card distribution carriage (201) along the track (250), and a drive motor (235) to move the card distribution carriage (201) along the track (250) to different locations to distribute the hands of cards (205) to the card delivery apparatuses (300).

Further referring to FIGS. 4 to 7, in one embodiment, the card receiving stack (210) includes a stack of individual compartments large enough to hold one on more playing cards (205). In one example, each compartment may hold between one and four cards depending on the game in play. The card receiving stack (210) is vertically moveable, and supported by receiving stack lifters (211) which in one embodiment, comprise rotating threaded rods (215) with nuts (216) threaded thereon. The nuts (216) are fixed to brackets at the base of the card receiving stack (210). When the threaded rods (215) rotate, the nuts (216), being held in place by the card receiving stack (210), move up or down depending on the direction of rotation thereby lifting or lowering the card receiving stack (210). In one embodiment, the receiving stack lifters (211) are attached with bearings to the carriage baseplate (202) and also connected to the receiving stack lifter support bracket (212) beneath the carriage baseplate (202) to provide horizontal stability. In one embodiment, the threaded rods (215) including the receiving stack lifters (211) may be rotated by a receiving stack lift motor (213) connected by the receiving stack lift belt (214). In one embodiment, the receiving stack lift motor (213) is a stepper type motor, allowing for the control of the number and degree of rotations of the threaded rods (215) comprising the receiving stack lifters (211) and therefore controlling the height of the receiving stack (210) to a precision that allows individual hands to be received and distributed from the individual compartments within the receiving stack (210).

Further referring to FIGS. 4 to 7, cards in individual hands may be distributed by the card distribution carriage (201) from the card receiving stack (210) to the card delivery apparatuses (300) by rotation of a card distribution feed roller (220). The card distribution feed roller (220) comprises a roller with a frictional outer surface that contacts the top side of the card being distributed from the card receiving stack (210) to move the card. In one embodiment, the card distribution feed roller (220) is connected by a shaft (225) to the card distribution feed roller motor (221). The feed roller motor (221) may be mounted at a height sufficient to contact the top surface of the cards within the card receiving stack (210). In one embodiment, the feed motor roller (221) is supported by an upper bracket (222) and a lower bracket (223) which may be hinged with a spring (224). The spring (224) is configured with the card distribution feed roller (220) to apply a constant force to the top surface of the cards. In one embodiment, within the card receiving stack (210) is a surface defining space allowing the card feed distribution roller (220) to move through the card receiving stack (210) and contact the cards (205) in each of the individual compartments, as the card receiving stack (210) changes height to distribute different hands to the different card delivery apparatuses (300).

Further referring to FIGS. 4 to 7, in one embodiment, the card distribution carriage (201) is supported by a track (250) comprising inner track sections (251) and outer track sections (252). The card distribution carriage (201) is connected to the track (250) by a plurality of wheels, comprising first support wheels (230), which contact the track (250) and support the card distribution apparatus (201) in the first direction, inner track wheels (231) which contact the inner track sections (251), and outer track wheels (232) which contact the outer track sections (252). In one example, at least one of the inner or outer wheels is a drive wheel (233) which is rotated by the drive wheel motor (235) connected by the drive wheel belt (234). When the drive wheel (233) is rotated by the force of the drive wheel motor (234), the drive wheel (233) causes motion of the card distribution carriage (201). In one embodiment, the drive wheel motor (234) is a stepper type motor allowing the position of the card distribution carriage (201) along the track (250) to be controlled by the number and degree of rotations of the drive wheel motor (234). In one embodiment, the drive wheel (233) utilizes gear teeth, with corresponding gear teeth cut into the inner track sections (251), to eliminate slippage in the drive of the card distribution carriage (201).

Further referring to the FIGS. 4 to 7, as the card distribution carriage (201) moves around the curved track (250) the distance between the inner track wheels (231) and the outer track wheels (232) slightly variable, and the angle of the support wheels (230) variable relative to the carriage baseplate (202). In one embodiment, to compensate for the change in the angle of the support wheels (230), the support wheels (230) are mounted to pivoting inner wheel mounts (240) on the side supported by the inner track sections (251) and to pivoting outer wheel mounts (241) on the side supported by the outer track sections (252). In one embodiment, the pivoting of the inner wheel mounts (240) is accomplished by wheel mount cam wheels (242) which maintain contact with the inner track sections (251) while the inner wheel mounts (240) pivot around the axis of the inner track wheels (231), and the pivoting of the outer wheel mounts (241) is accomplished by wheel mount cam wheels (242) which maintain contact with the outer track sections (251) while the outer wheel mounts (241) pivot around the axis of the outer track wheels (231). In one embodiment, wheel mount pivot springs (244) maintain a force applying the wheel mount cam wheels (242) to the track (250), in doing so the inner wheel mounts (240) and the outer wheel mounts (241) align the support wheels (230) with the direction of the track (250). In one embodiment, to compensate for the slight variation of the distance between the inner track wheels (231) and the outer track wheels (232), the outer wheel mounts (241) are connected to the carriage baseplate (202) by outer wheel mount arms (243) which pivot at both ends, allowing the outer wheel mounts (241) to pivot under the action of the wheel mount cam wheels (241) while also allowing the outer track wheels (232) to move relative to the carriage baseplate (202) in the direction perpendicular to the track (250), therefore allowing the distance between the inner track wheels (231) and the outer track wheels (232) to change as the card distribution carriage (201) moves around the straight and curved sections of the track (250). In one embodiment, the outer track wheels (232) and the outer wheel mounts (240) are held against the outer track sections (252) by outer wheel mount arm springs (244) which connect the carriage baseplate (202) to the outer wheel mount arms (243) and provide a force at the axis of the horizontal outer track wheels (231) against the outer track sections (252).

Figure 8:
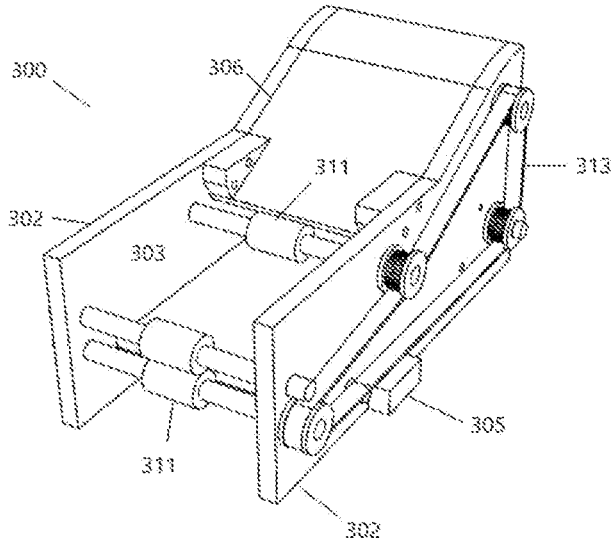
FIG. 8 is a perspective view of one embodiment of an individual player card holding and delivery mechanism.
Figure 9:
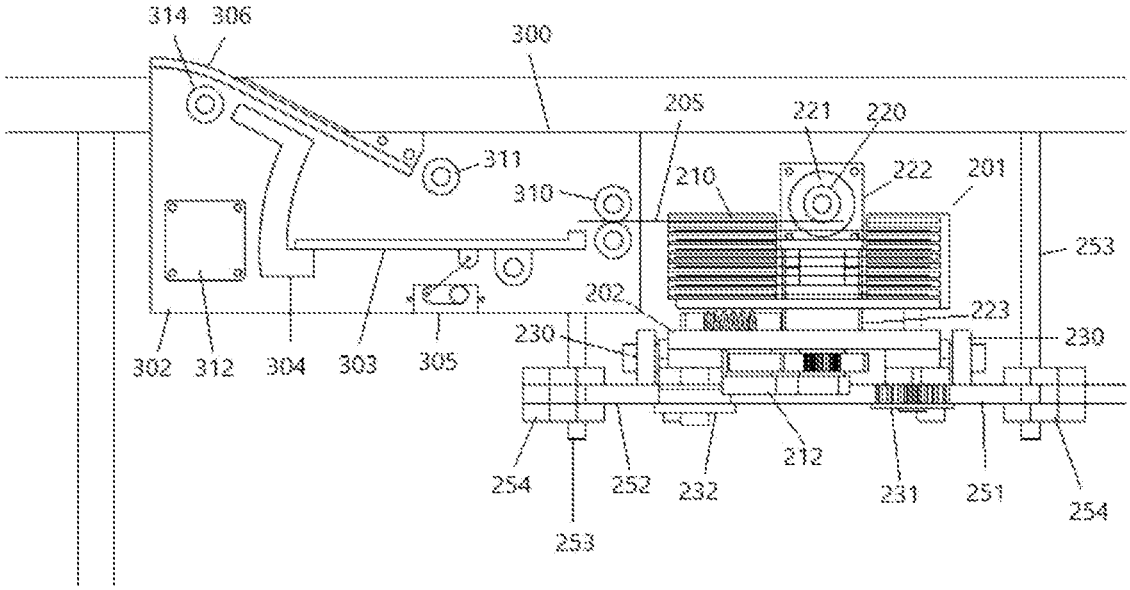
FIG. 9 is a cut away side view of one embodiment of a player delivery mechanism and the card distribution carriage with the supporting track.

Referring now to FIGS. 8 and 9, in one embodiment, the card delivery apparatuses (300) comprises a pivoting baseplate (303), a curved endplate (304), a card delivery cover (306), delivery apparatus pickup rollers (310), card delivery rollers (311), and side plates (302). The side plates (302) provide the support for the other components of the card delivery apparatus (300) and are spaced apart enough for the cards to easily move in the space within the card delivery apparatus (300) and while maintaining the alignment of the cards. The cards for a single hand are moved one at a time from the card receiving stack (210) on the card distribution carriage (201) by the card distributor feed roller (220) into the card delivery apparatus (300) where each card contacts the delivery apparatus pickup rollers (310) which continue to move the card into the card delivery apparatus (300) until the card is deposited onto the pivoting card holder baseplate (303). In one embodiment, the delivery apparatus pickup rollers (310) comprise a frictional outer surface on a shaft, rotated by a delivery apparatus motor (312). In one embodiment, the pickup rollers (310) and the motor (312) are connected by a delivery apparatus roller belt (313). In one embodiment, each card in the hand is received by the card delivery apparatus (300) and deposited onto the card holder baseplate (303) until the full hand is received by the card holder baseplate (303) where the cards await the start of the next hand of play when the cards are moved to the surface of the gaming table. In one embodiment, at the far end of the card holder baseplate (303), relative to the delivery apparatus pickup rollers (310), is a curved endplate to restrict the motion of the cards preventing the cards from moving off the card holder baseplate (303).

Referring again to FIGS. 8 and 9, when the next hand is to be delivered, the pivoting card holder baseplate (303) is pivoted upwards. In one embodiment, this is accomplished by the action of a baseplate lifting servo motor (305) having a lever arm connected to the card holder baseplate (303) by a pushrod and rotated an amount that allows the pushrod to pivot the card holder baseplate (303) until the upper surface of the cards being held are in contact with a first delivery roller (311). In one embodiment, the cards are moved from the card holder baseplate (303) across the top of the endplate (304) and beneath the delivery apparatus cover (306) by rotation of the first delivery roller (311) and then onto the surface of the gaming table by rotation of a second delivery roller (314). In one embodiment, the first delivery roller (311) and the second delivery roller (314) comprise a frictional outer surface on a shaft, rotated by a delivery apparatus motor (312) connected to the shaft by a delivery apparatus roller belt (313). Because the cards do not touch the delivery apparatus pickup rollers (310) when they are delivered to the player position on top of the gaming table, and because they do not touch the first delivery roller (311) or second delivery roller (314) when they are brought into the card delivery apparatus (300) by the delivery apparatus pickup rollers (310), all the rollers may operate by the rotation of a single motor. The first delivery roller (311) and the second delivery roller (314) continue to rotate until all the cards in the hand have been delivered to the surface of the gaming table. When all the cards in the hand have been delivered to the surface of the gaming table, the baseplate lifting servo motor (305) returns the pivoting card holder baseplate (303) to its original position ready to receive the cards for the next hand.

Figure 10:
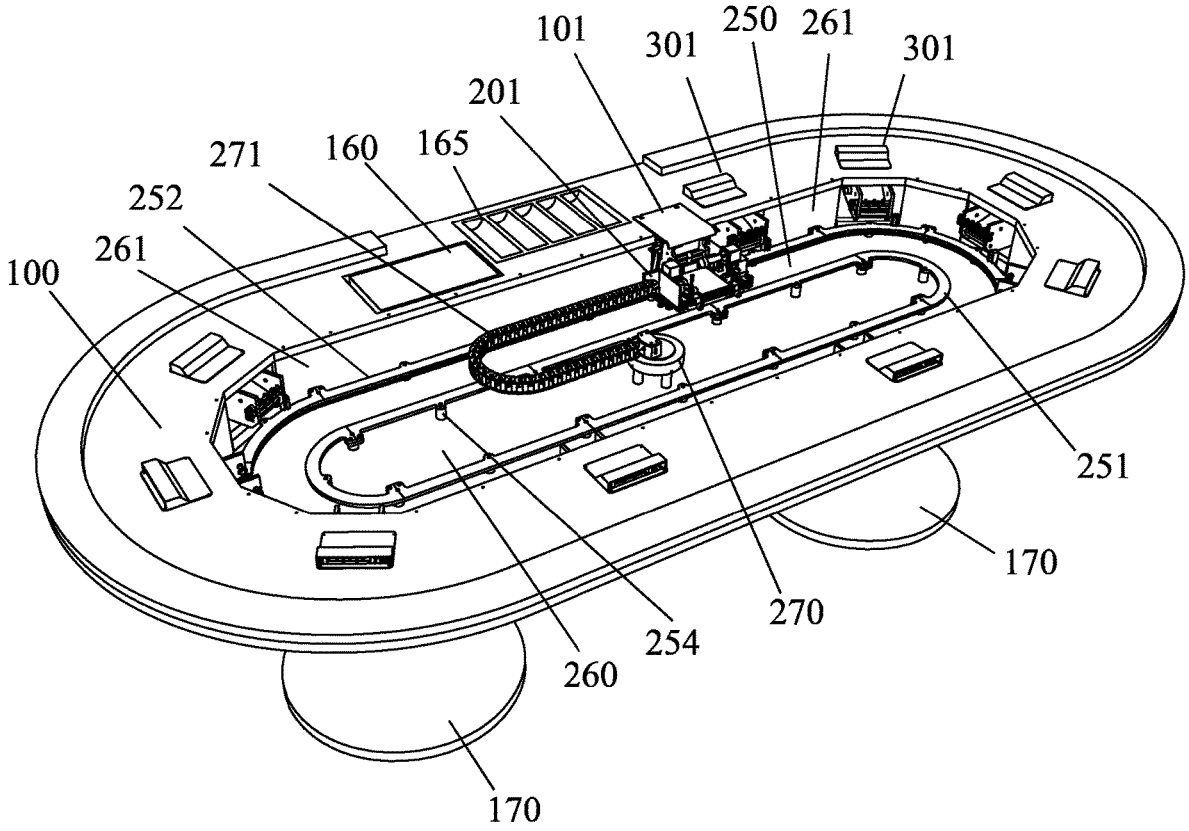
FIG. 10 is a perspective view of the gaming table of FIG. 1 with a removable panel removed to provide access to the card dealing system.

Referring to FIG. 10, a perspective view of an alternative embodiment of the present invention is shown. In this embodiment, the card input apparatus (101), card distribution carriage (201), at least one card delivery apparatus (300) and the card distribution carriage track (250) are supported by a lower table surface (260), attached to the upper surface of the table by side walls (261), creating a container for the card distribution carriage (201) and carriage track (250) while also providing a structure for table support stands (170) to attach from underneath. In this embodiment, the upper surface of the gaming table features a removable central section which has been removed in FIG. 10 permitting the internal mechanisms to be seen. In practice, removing the central section allows access to the internal mechanisms for maintenance and installation. The carriage track (250) is supported from below by spacers (254) and affixed to the lower table surface (260) by fasteners such as bolts or screws. In the embodiment of FIG. 10, the card distribution carriage track (250) has gear teeth set into the outer carriage track sections (252) and the card distribution carriage (201) is driven by one of the outer wheels.

Referring still to FIG. 10, in one embodiment of the present invention, a flexible cable carrier (271) supports and contains the electrical wiring that provides the power and signals for the motors and other components of the card distribution carriage (201), connecting on one end to the card distribution carriage (201) and on the other end to a freely rotating wire hub (270) mounted to the lower table surface (260). The wires going through the wire hub (270) may be connected by a slip ring inside the hub (270) to allow the wiring to freely rotate without tangling. In one embodiment, the wire hub (270) connects the movable card distribution carriage (201) to the stationary lower table surface (260) by the cable carrier (271), which is flexible in the plane of the lower table surface (260) and is moved on one end by the force of the distribution carriage (201), and free to rotate on the other end fixed to the wire hub (270), allowing the distribution carriage to make unlimited complete circuits of the carriage track (250). In one embodiment, the gaming table (100) also features space for a card shuffling machine (160) and poker chip tray (165)

Figure 11:
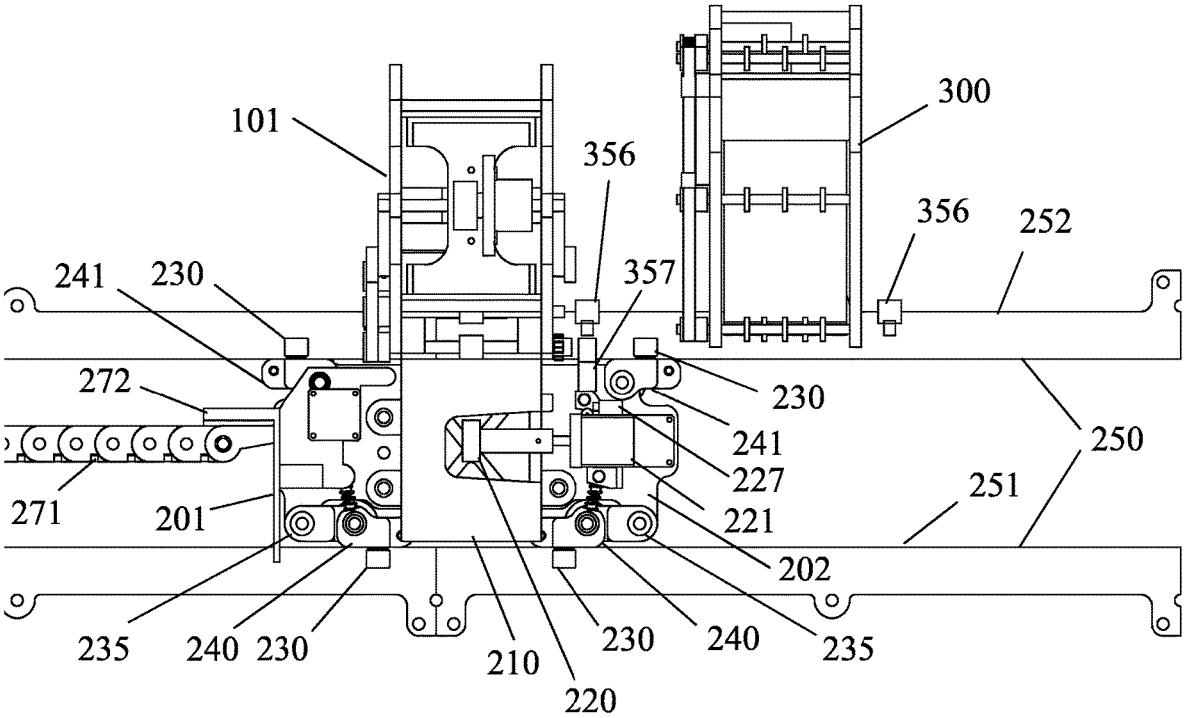
FIG. 11 is a side view of the card distribution carriage and the track.

Referring to FIG. 11, shown is a top view of the card input apparatus (101), the card distribution carriage (201) and one of the card delivery apparatus (300) connected by the carriage track (250). In this embodiment, the cable carrier (271) is shown connected to the card distribution carriage (201) by a cable carrier bracket (272), supporting the end of the cable carrier (271). In one embodiment, the support wheels (230) are mounted to pivoting inner wheel mounts (240) on the side supported by the inner track sections (251) and to pivoting outer wheel mounts (241) on the side supported by the outer track sections (252). In one embodiment, the inner track wheels (232) and the inner wheel mounts (240) are connected to the carriage baseplate (202) by inner wheel mount arms (235) which pivot at both ends, allowing the inner wheel mounts (240) to pivot under the action of the wheel mount cam wheels (231) while also allowing the inner track wheels (232) to move relative to the carriage baseplate (202) in the direction perpendicular to the track (250).

Referring still to FIG. 11, the feed roller motor (221) is mounted at a height sufficient to contact the top surface of the cards within the card receiving stack (210) and is supported by a feed roller servo motor (227) mounted such that the feed roller motor (221) may rotate under the action of the feed roller servo motor (227) around the vertical axis to move the feed roller (220) out of the path of the card receiving stack (210) while the cards are being moved into the card receiving stack (210) from the card input apparatus (101). If the same space within the card receiving stack (210) is meant to accept cards at different positions in the dealing order, such a configuration prevents the feed roller (220) from interfering with the loading of the cards when different dealing orders are used to make hands of cards. The feed roller servo motor (227) may return the feed roller motor (221) and feed roller (220) to their original positions, with the feed roller (220) positioned above the card receiving stack (210) and in an orientation to move cards out of the card receiving stack (210) and into a card delivery apparatus (300).

Referring still to FIG. 11, in one embodiment, a magnetic sensor (357) is connected to the card distribution carriage (201) in a position allowing the magnetic sensor (357) to become activated when in proximity to a magnetic position indicator (356). In one embodiment, at least one magnetic position indicator (356) is mounted to the outer track (252) at a position where the magnetic position indicator (356) is aligned with the magnetic sensor (357) on the card distribution carriage (201), while the distribution carriage (201) is correctly aligned with the card input apparatus (101) or card delivery apparatus (300), ensuring cards can be transferred between. Other sensors, such as optical sensors may be used rather than, or in addition to, magnetic sensors (357).

Figure 12:
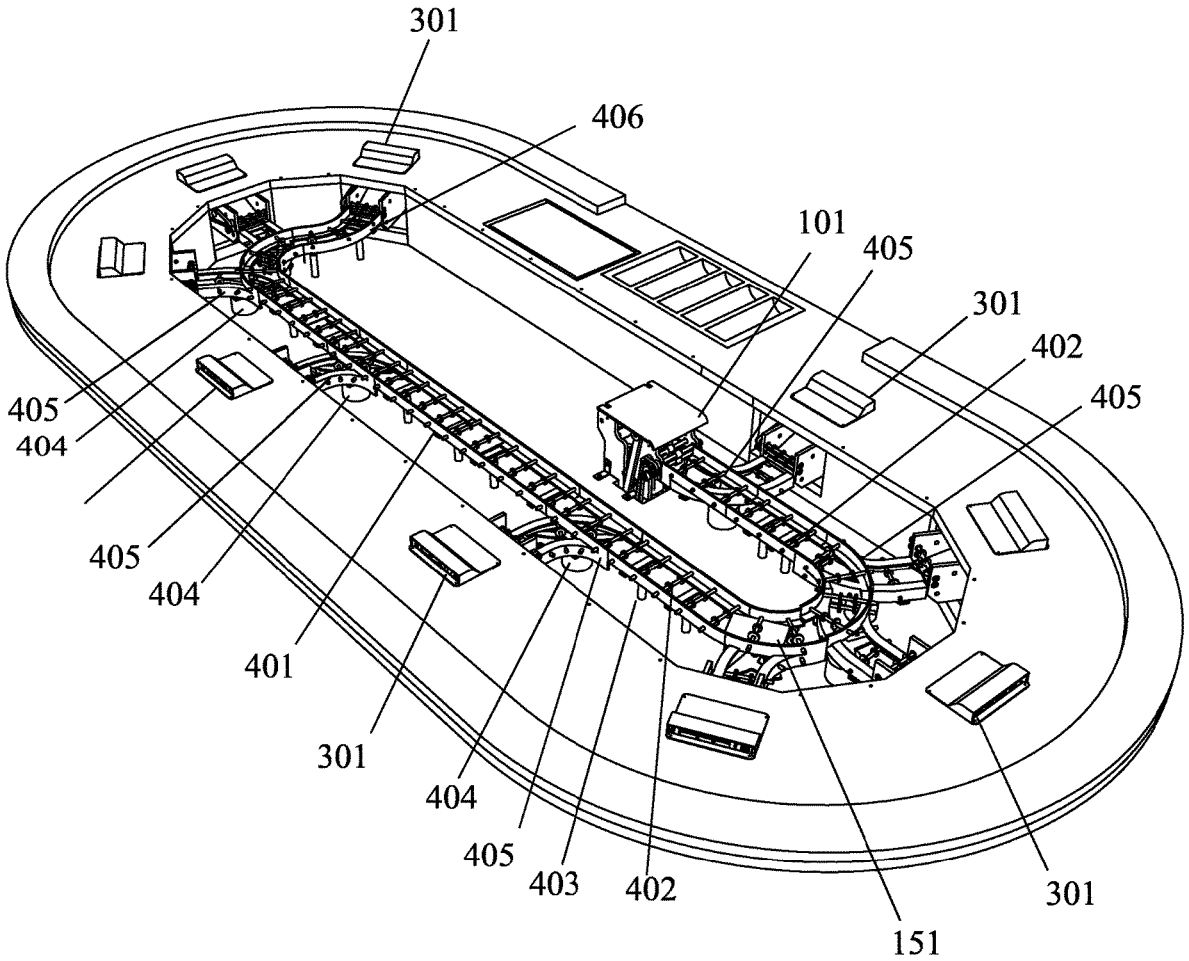
FIG. 12 is a top down perspective view of another embodiment of the present invention including a conveyor mechanism.

Now referring to FIG. 12, shown is an alternative embodiment of the present invention having a conveyor mechanism (401) to move cards (151) from the card input apparatus (101) to the card delivery apparatuses (300). In this embodiment, the card input apparatus (101) pushes the top card of the deck (151) onto a conveyor mechanism (401) which uses a system of rollers (402) or other conveyor methods to move the individual cards (151) along the conveyor mechanism (401). In one embodiment, a gate mechanism (405) having a variable position directs, when in one position, the card to continue to move along the conveyor mechanism (401) and, when in a second position, directs the card (151) out of the conveyor mechanism (401) and into a card distribution apparatus (300). As individual cards (151) are conveyed from the card input apparatus (101) around the underside of the gaming table (100), the gate mechanisms (405) change position to direct the cards (151) into the appropriate delivery apparatus (300) for the desired dealing pattern of cards to their respective players. As an example, if the first card from the top of the one or more decks of cards is to be dealt to the first player to the left of the dealer, then as the first card is moved from the card input apparatus (101) onto the conveyor mechanism (401), the gate mechanism (405) corresponding to the first player to the left of the dealer changes position, so that when the first card arrives at the gate mechanism (405), the card is directed into the card delivery apparatus (300) for the first player position, rather than continuing along the conveyor mechanism (401) to the subsequent player positions. Then, for the second card, the second gate mechanism (405) changes position, and so on, until all the required cards have been dealt to the players at their respective player positions. In one embodiment, the final conveyor section (406) can be connected to the final card delivery apparatus (300) negating the need for a gate mechanism (405) as there is no need for the card (151) to travel any further or be directed off of the conveyor (401). In one embodiment, the conveyor mechanism (401) comprises a track of rollers (402), supported on both sides by a track, and may be driven by a rotational power source such as motors with the entire mechanism supported by connectors (403) to the lower or upper table surface. In one embodiment, the gate mechanisms (405) is supported by a linear actuator, piston, or solenoid (404) connecting the gate mechanism (405) to the upper or lower table surface facilitates the change of position of the gate mechanism (405) that directs a card (151) either along the conveyor (401) or into a card delivery apparatus (300)

Figure 13:
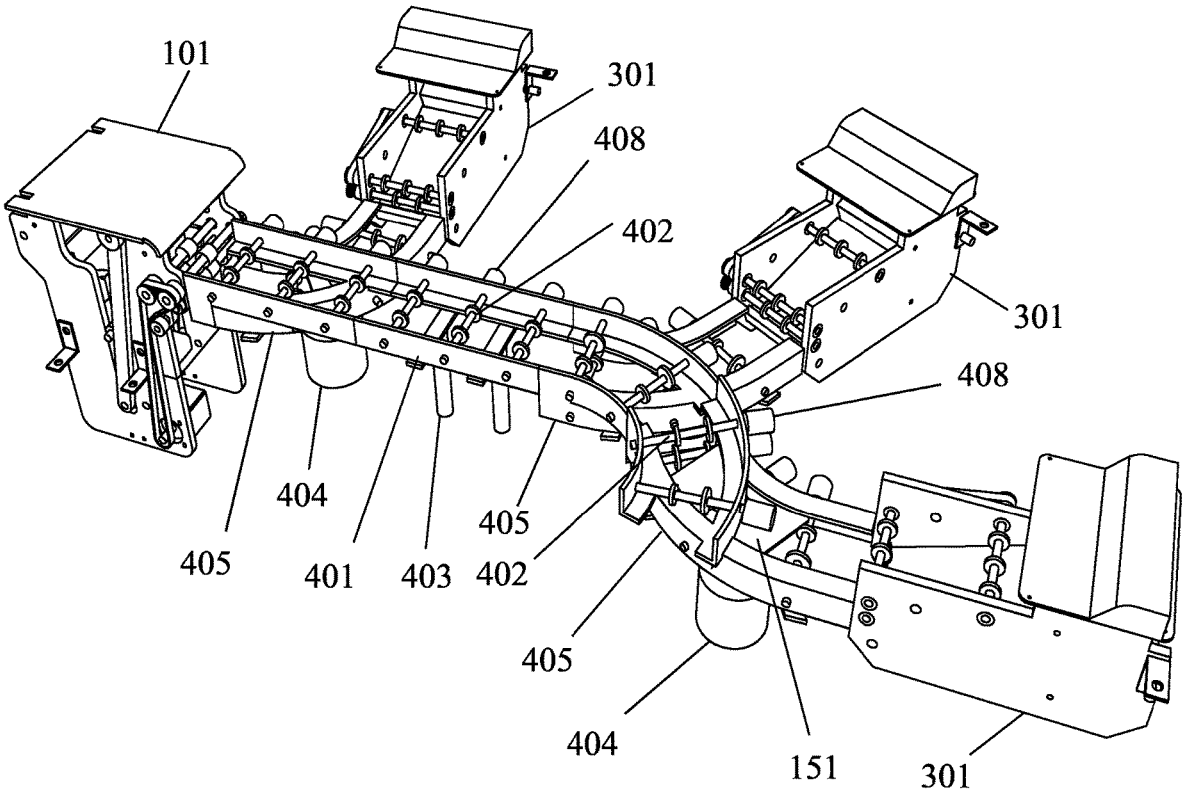
FIG. 13 is a top down perspective view showing a more detailed view of the conveyor mechanism.

Referring to FIG. 13, shown is a more detailed view of the embodiment of the present invention. In the embodiment shown, conveyor motors (408) drive the conveyor rollers (402), providing the rotational force to turn the rollers (402) which have a frictional surface to move cards (151) from the card input apparatus (101) along the conveyor (401), or into a card delivery apparatus (300) through a gate mechanism (405). The gate mechanisms (405) may be sub-components of the conveyor mechanism (401) that allow multiple pathways for a card (151) to be directed, which in one embodiment are arranged with a top conveyor portion that connects to the further sections of the conveyor mechanism (405), and a bottom conveyor portion that connects to a card delivery apparatus (300). When a gate solenoid (404) or actuator is engaged (open gate), the bottom conveyor section of the gate mechanism (405) aligns with the prior section of the conveyor mechanism (401) to carry a card (151) along the bottom conveyor portion into a card delivery apparatus (300). When a gate solenoid (404) is not engaged (closed gate), the top section of the gate mechanism (405) aligns with the prior and remaining sections of the conveyor mechanism (401) to convey the card (151) along the conveyor mechanism (401) or into the subsequent gate mechanism (405) sub-components. In one embodiment, sections of the conveyor mechanism (401) that are stationary are supported by connectors (403) to the lower surface of the inside of the gaming table. This embodiment allows a card (151) or multiple cards to be moving along the conveyor mechanism (401) simultaneously, with the gate mechanism solenoids (404) being actuated with the correct sequence and timing as the cards (151) move along the conveyor mechanism (401) through subsequent gates (405) resulting in the proper distribution of cards for the game being played.

Figure 14:
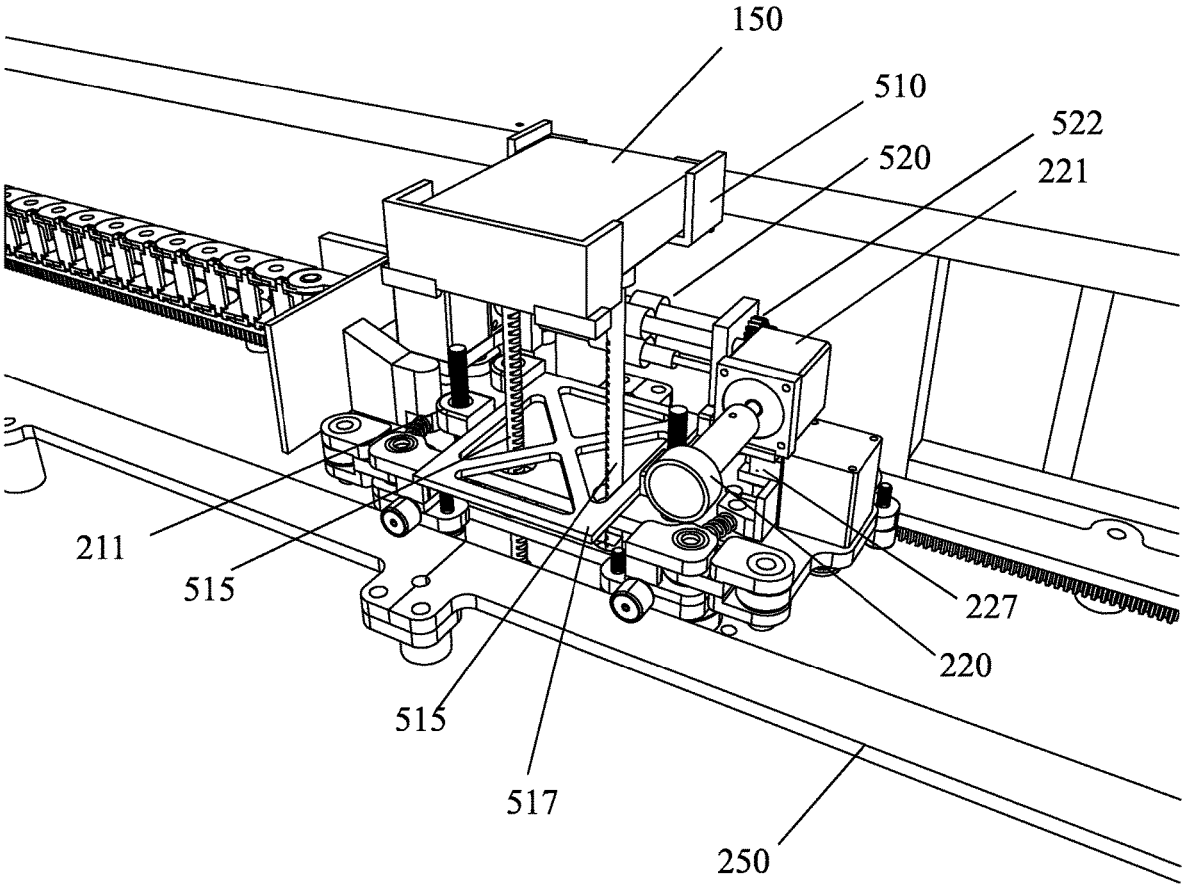
FIG. 14 is a perspective view of another embodiment of the present invention showing a loading mechanism for one or more decks of cards to be carried by a card holder within a card distribution carriage along a track.
Figure 15:
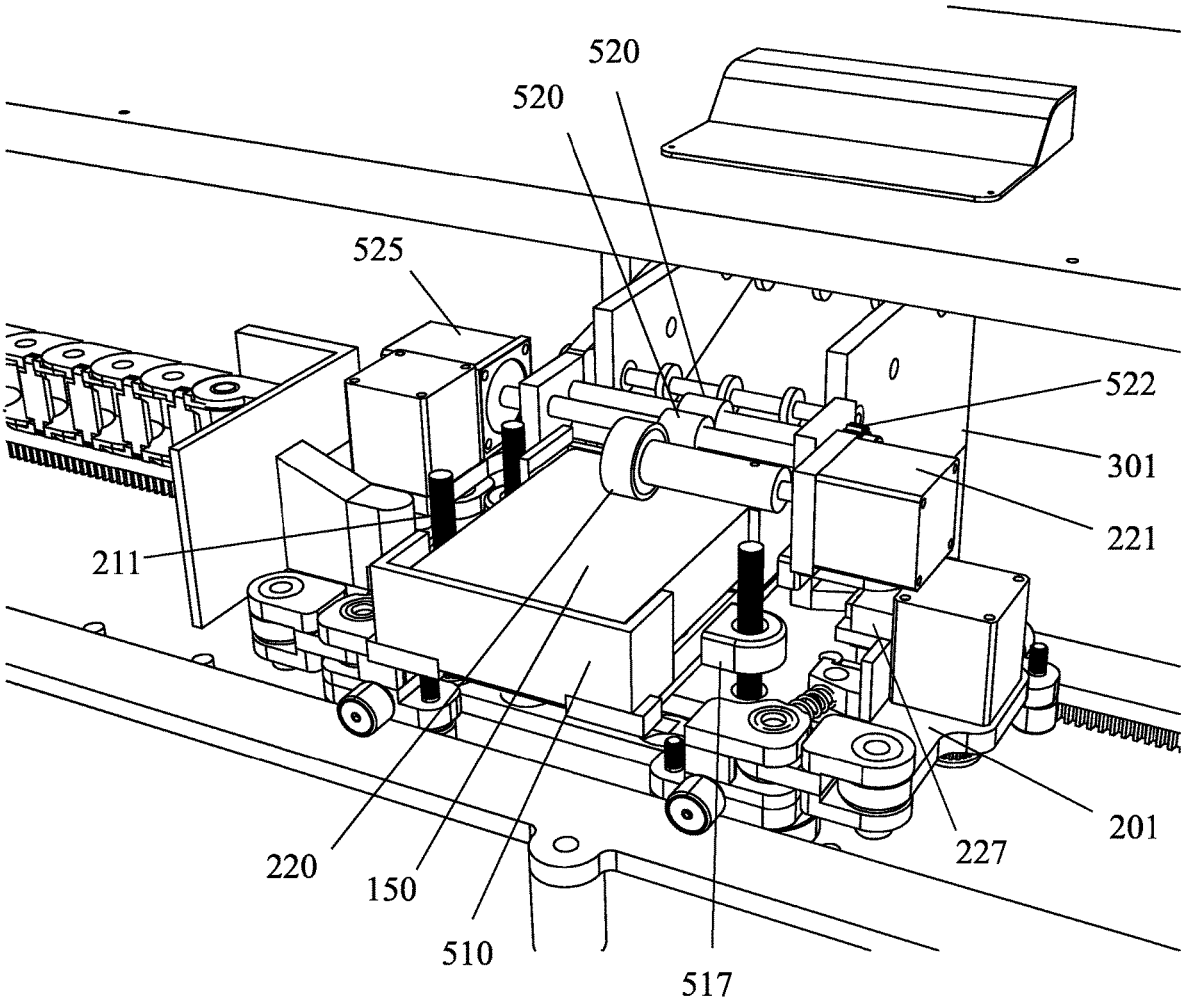
FIG. 15 is a perspective view of the embodiment of the present invention of FIG. 14 showing one more decks of cards carried by a card holder within a card distribution carriage on a track and a card delivery apparatus.

Now referring to FIGS. 14 and 15 another embodiment of the present invention is shown. In this embodiment, the one or more decks of cards (150) are placed into a card holder (510) that can be elevated by a loading mechanism (515) in a location along the track (250) in proximity to the dealer. In one embodiment, the loading mechanism (515) uses a gear rack and pinion or other method for lifting the card holder (510) to the level of the top surface of the gaming table, accessible to the dealer by raising a cover lid (120) similar to the embodiment shown in FIGS. 3 and 4. In the embodiment shown in FIGS. 14 and 15, the card holder (510) containing the one or more decks of cards (150) is lowered onto the card distribution carriage (201) by the loading mechanism (515) which then disengages with the card deck holder (510) and retracts below the card distribution carriage (201). The one or more decks of cards (150) and the card deck holder (510) can then be carried by the card distribution carriage (201) around the track (250). In this embodiment, the card deck holder (510) is supported by a vertically movable stack lifter platform (517), which may be moved vertically by stack lifters (211) in small increments to maintain contact between the top card of the card deck (150) and the card delivery feed roller (220). The delivery feed roller (220) can be rotated with respect to the vertical by a feed roller servo (227), so that when the loading mechanism (515) is engaged with the card deck holder (510) to lift it, the position of the feed roller (220) does not interfere with the lifting of the deck holder (510).

Further referring to the embodiment shown in FIGS. 14 and 15, the card distribution carriage (201) may be programmed or use sensors to move to the one or more decks of cards (150) to the locations of the card delivery apparatuses (300) at the player locations along the track (250). In this embodiment, the cards may be transferred to the card delivery apparatuses (300) utilizing the rotation of the card delivery feed motor (221) and delivery feed roller (220), and then moving through a set of pickup rollers (520), driven by a pickup roller motor (520), which, as shown, is affixed to the card distribution carriage (201). When delivering cards to one of the card delivery apparatuses (300), the delivery feed motor (221) and feed roller (220) can be rotated by the feed roller servo (227) so the axis of the roller is perpendicular to the one or more decks of cards (150), so that the feed roller (220), by rotating with contact to the upper card deck surface, moves the top card of the card deck (150) into the pickup rollers (520). The pickup rollers (520) can be connected by pickup roller gears (522) so that multiple pickup rollers (520) can be driven by a single pickup roller motor (525). Using a delivery feed roller (220) coupled with pickup rollers (520) together as part of the card distribution carriage (201) ensures that the correct number of cards are moved between the one or more decks of cards (150) and each of the card delivery apparatuses (300) at the player locations.

Figure 16:
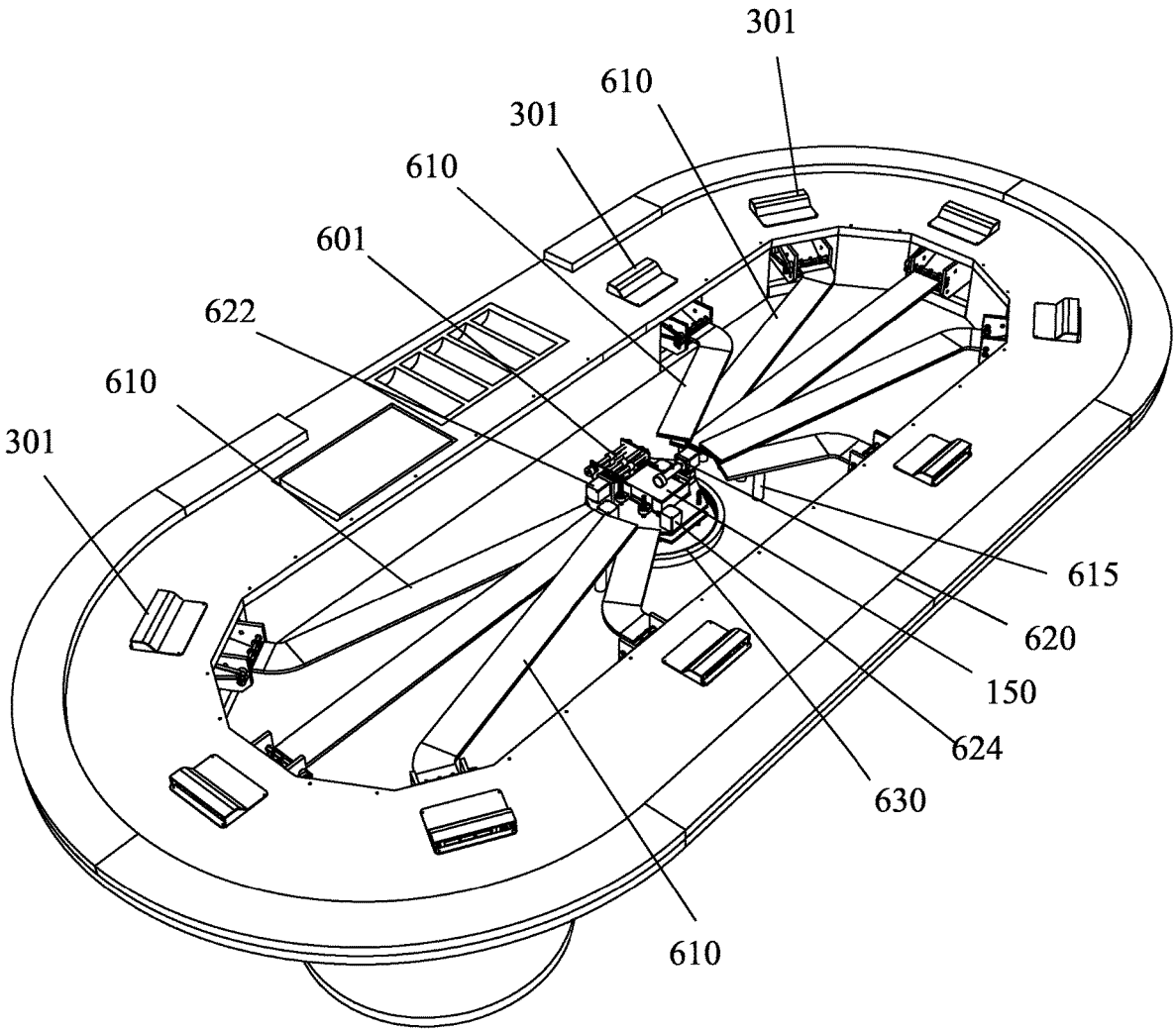
FIG. 16 is a perspective view of an embodiment using a rotating central hub card dealing mechanism and a plurality of spoke-like or chute-like conveyor mechanisms.
Figure 17:
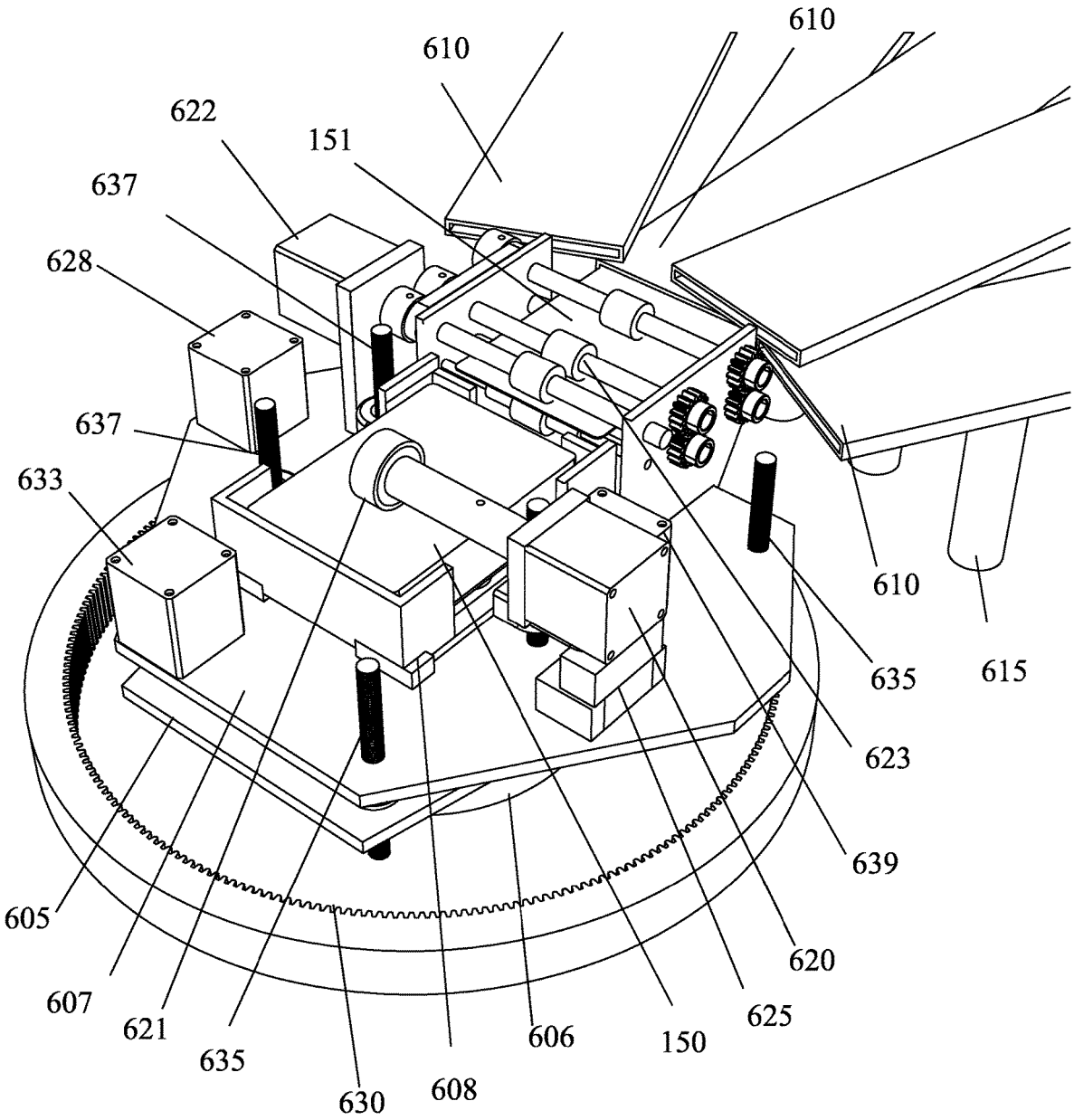
FIG. 17 is a perspective view of a central hub device of the embodiment of the present invention of FIG. 16.

Now referring to FIGS. 16 and 17, an embodiment of the present invention is shown using a rotating central hub card dealing mechanism (601) and a plurality of spoke-like or chute-like conveyor mechanisms (610) to move individual cards from the top of the one or more decks of cards (150) from a central hub dealing mechanism (601) to the card delivery apparatuses (300) for delivery to the players at the beginning of each hand as previously described. In one embodiment, the central hub dealing mechanism (601) uses a card dealer feed motor (620) that rotates a dealer feed roller (621) with a frictional surface to move a card (151) horizontally from the top of the one or more decks of cards (150) into the dealing pickup rollers (623) rotated by a pickup roller motor (622) and then into one of the plurality of spoke conveyor mechanisms (610). In one embodiment, the central hub dealing mechanism (601) rotates around the vertical axis by operation of a hub rotation motor (628) acting on a fixed hub gear (630), and is moved linearly in the vertical direction by a set of threaded, rotating lifting rods (635) being driven by a hub vertical positioning motor (633). This arrangement allows the central hub dealing mechanism (601) to be rotated and moved vertically into a position of alignment between the deck pickup rollers (623) and the inner end of any of the spoke conveyor mechanisms (610), allowing cards to be moved from the central hub dealing mechanism (601) into the spoke conveyor mechanisms (610).

In one embodiment, the central hub dealing mechanism (601) is comprised of a lower hub platform (605) supported by a hub bearing (606) containing a slip ring for electrical wiring. The central hub dealing mechanism (601) may also be comprised of an upper hub platform (607) supported by threaded lifting rods (635), such that rotation of the lifting rods (635) increases the distance between upper hub platform (607) and the lower hub platform (605) effectively increasing or decreasing the height of the upper hub platform (607) relative to the surface of the table. The dealing feed rollers (621), dealing feed motor (620), pickup rollers (623) and pickup roller motor (622) are mounted to the upper hub platform (607), so that the position of the feed rollers (621) and pickup rollers (623) can be adjusted to match the height of the spoke conveyor mechanisms (610) as individual cards (151) are dealt from the top of the one or more decks of cards (150) into the conveyor mechanisms (610) which carry the cards to card delivery apparatuses (300) underneath the table at the individual player positions.

As shown in FIGS. 16 and 17, one or more decks of cards (150) are supported by the card holder tray (608), which is connected to the upper hub platform (607) by a set of threaded deck lifting rods (637) capable of rotating, with the threads acting upon the card holder tray (608), such that it can be raised or lowered relative to the upper hub platform (607). The rotation of the deck lifting rods (637) can be accomplished by the rotation of a deck lifter motor (639) where the shaft of the motor (639) is connected to the deck lifting rods (637) by a drive belt or gears. In the embodiment shown, loading the one or more decks of cards (150) is accomplished by the deck lifter motor (639) raising the card holder tray (608) through a hole in the upper play surface of the table such that a lid can be opened to allow the dealer to place the one or more decks of cards (150) in the card holder tray (608). While this happens, the dealing feed motor (620) and the feed roller (621) are rotated relative to the card holder tray (608) by a dealing feed motor servo (625) which rotates the feed roller out of the path of the card holding tray (608) as it is lifted by the deck lifting rods (637) through the upper surface of the table to be accessed by the dealer. When the one or more deck of cards (150) and the card holder tray (608) are lowered to a position for moving the cards into the conveyor mechanisms (610), the dealing feed motor servo (625) rotates the feed roller motor (620) and the feed roller (621) into the perpendicular position allowing the feed roller (621) to move cards off the top of the one or more decks of cards (150). The deck lifting rods (637) may also adjust the height of the one or more decks of cards (150) relative to the dealing feed roller (621) so that as individual cards (151) are moved from the one or more decks of cards and the one or more decks of cards become thinner, the feed roller (621) remains in contact with the top surface (151) of the one or more decks of cards (150).

FIGS. 16 and 17 further show individual cards (151) being moved by the feed roller (621) and the pickup rollers (623) into the opening of the conveyor mechanisms or card-delivery pathways (610) where the individual cards can be conveyed by such means as a conveyor belt or rollers such as previously discussed above. In another embodiment, the individual cards (151) can be pushed through the conveyor mechanisms (610) by directed air pressure. In such an embodiment, a support stand (615) contains an air tube for supplying air through a nozzle into the conveyor mechanism (610), thereby creating a force necessary to move the individual cards (151) through the length of the conveyor mechanisms (610) and into the card delivery apparatuses (300) where they can be delivered to the players. Alternatively, one or more card distribution carriages (like that shown in FIG. 5) may transport the cards from the card holder tray (608) along the card-delivery pathways (610) to the card delivery apparatuses (300).

Figure 18:
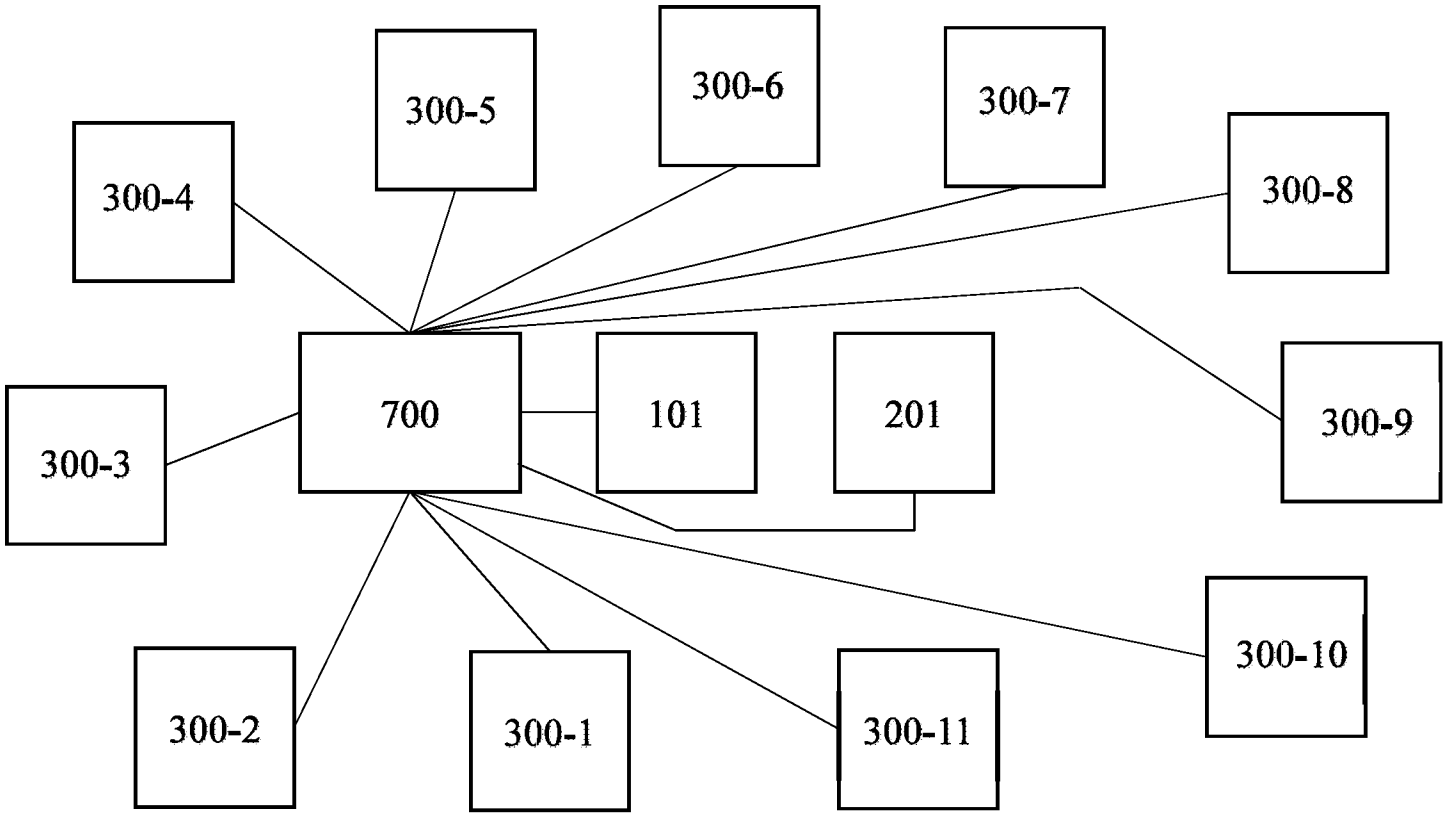
FIG. 18 is a schematic of one embodiment of the present invention.

FIG. 18 shows a schematic of one embodiment of the present invention. One or more processors 700 communicate with, and control the card input apparatus (101), card distribution carriage (201) and card delivery apparatuses (300-1 through 300-11). In one embodiment, each of the card input apparatus (101), card distribution carriage (201) and card delivery apparatuses (300) has its own processor. Alternatively, one or more central processors may control everything. With a central processor arrangement, communication between the one or more processors 700 and the card input apparatus (101), card distribution carriage (201) and card delivery apparatuses (300) may be via wireless and/or wired signals. Controlling the card input apparatus (101) comprises lowering the card deck holder (110) and then individually transferring cards from the card deck holder (111) to the card distribution carriage (201) by activating the feed rollers (130). Controlling the card distribution carriage (201) comprises activating pickup rollers (140) to receive cards from the card deck holder (110), moving and stopping said card distribution carriage (201) about the track (250) and activating feed rollers (140) to receive and dispense cards to the card delivery apparatuses (300) spaced about the gaming table via the card distributor feed roller (220). Controlling the card delivery apparatuses (300) comprises activating the delivery apparatus pickup rollers (310) to receive cards from the card distribution carriage (201), pivoting the card holder baseplate (303) upwards and activating the first delivery roller (311) and the second delivery roller (314) to transfer the cards to the upper surface of the gaming table. One or more processors may be similarly configured to control the components of other embodiments, including those detailed herein.

While not shown, sensors (e.g., optical, proximity, etc.) at the gaming table determine which player positions are occupied. The sensor outputs are transmitted to the one or more processors ensuring that cards are only dealt to the player positions occupied by players. In one embodiment, a display proximate the dealer identifies which player positions the system shows as occupied. The display allows the dealer to confirm the proper player positions are receiving cards. In one embodiment, the dealer may manually input, via a user interface of the system, the numbers of the occupied player positions.

The dynamic components of the various embodiments described above can be powered using batteries and/or standard electrical power.

Although the invention has been described in detail with reference to several embodiments, additional variations and modifications exist within the scope and spirit of the invention as described and defined in the following claims.

We claim:

1. A gaming table system comprising:

a card input apparatus including a card holder configured to hold a stack cards;

a card distribution carriage for receiving cards from said card holder;

a plurality of player positions;

a track moveably supporting said card distribution carriage, said track and card input apparatus attachable to an underside of a gaming table whereby said track extends between player positions about said gaming table; and wherein said card distribution carriage is configured to move along said track to card delivery apparatuses located proximate to said player positions, said card delivery apparatuses configured to deliver a pre-established number of cards received from said card distribution carriage to an upper surface of said gaming table at said player positions.

2. The gaming table system of claim 1 wherein said card distribution carriage includes a card distribution card stack for receiving cards from said card holder.

3. The gaming table system of claim 1 wherein said card input apparatus includes one or more mechanisms for removing cards from said card holder.

4. The gaming table system of claim 1 wherein said card distribution carriage includes one or more mechanisms for moving cards from said card distribution card stack to said card delivery apparatuses.

5. The gaming table system of claim 1 further comprising a spring-biased mechanism for applying an upward force to said card holder.

6. The gaming table system of claim 1 wherein said track comprises an inner track section and outer track section.

7. The gaming table system of claim 6 wherein said card distribution carriage includes inner wheels for engaging said inner track section and outer wheels for engaging said outer track section.

8. The gaming table system of claim 1 wherein said card input apparatus includes a lid providing access to said card holder via an upper surface of said gaming table.

9. The gaming table system of claim 1 wherein said card delivery apparatuses include one or more mechanisms for moving cards delivered from said card distribution carriage to an upper surface of said gaming table.

10. The gaming table system of claim 1 further comprising a cable carrier containing electrical wiring providing power and signals for components of said card distribution carriage.

11. The gaming table system of claim 1 further comprising one or more magnetic sensors connected to said card distribution carriage and one or more magnetic position indicators mounted to said track to cause alignment of said card distribution carriage with (i) said card input apparatus and/or (ii) said card delivery apparatuses.

12. The gaming table system of claim 1 wherein said card holder is configured to move vertically and engage said card distribution carriage.

13. The gaming table system of claim 12 wherein said card distribution carriage is configured to receive and retain said card holder and remove cards therefrom for delivery to said card delivery apparatuses.

* * * * *